US011746593B2

(12) United States Patent
Greening

(10) Patent No.: US 11,746,593 B2
(45) Date of Patent: Sep. 5, 2023

(54) ROLLER BLIND APPARATS

(71) Applicant: Louver-Lite Limited, Hyde (GB)

(72) Inventor: Andrew Greening, Hyde (GB)

(73) Assignee: LOUVER-LITE LIMITED, Hyde (GB)

( * ) Notice: Subject to any disclaimer, the term of this patent is extended or adjusted under 35 U.S.C. 154(b) by 9 days.

(21) Appl. No.: 17/272,979

(22) PCT Filed: Sep. 16, 2019

(86) PCT No.: PCT/EP2019/074753

§ 371 (c)(1),
(2) Date: Mar. 3, 2021

(87) PCT Pub. No.: WO2020/053450

PCT Pub. Date: Mar. 19, 2020

(65) Prior Publication Data

US 2022/0049547 A1 Feb. 17, 2022

(30) Foreign Application Priority Data

Sep. 14, 2018 (GB) ..... 1815046

(51) Int. Cl.

| | |
|---|---|
| ***E06B 9/50*** | (2006.01) |
| ***E06B 9/58*** | (2006.01) |
| ***E06B 9/70*** | (2006.01) |
| ***E06B 9/78*** | (2006.01) |

(52) U.S. Cl.

CPC ..... *E06B 9/50* (2013.01); *E06B 9/58* (2013.01); *E06B 9/70* (2013.01); *E06B 9/78* (2013.01); *E06B 2009/785* (2013.01)

(58) Field of Classification Search

CPC ..... E06B 9/50; E06B 9/58; E06B 9/70; E06B 9/78; E06B 2009/785

See application file for complete search history.

(56) References Cited

U.S. PATENT DOCUMENTS

| | | |
|---|---|---|
| 2011/0132556 A1 | 6/2011 | Kao |
| 2018/0002981 A1 | 1/2018 | Colson et al. |

FOREIGN PATENT DOCUMENTS

| | | |
|---|---|---|
| CN | 102733749 | 10/2012 |
| CN | 202467609 | 10/2012 |
| EP | 1727958 | 12/2006 |
| EP | 2053193 | 4/2009 |

(Continued)

OTHER PUBLICATIONS

International Search Report and Written Opinion dated Dec. 10, 2019 in International Patent Application No. PCT/EP2019/074753.

*Primary Examiner* — Beth A Stephan
(74) *Attorney, Agent, or Firm* — Billion & Armitage

(57) ABSTRACT

A roller blind apparatus comprising a control apparatus; an idle end; and a roller tube located between the control apparatus and the idle end, wherein the control apparatus is coupled to a first corner bracket; the idle end includes one of an idle end spindle and an aperture and a second corner bracket includes the other the idle end spindle and an aperture, wherein the idle end spindle is rotatably mounted within the aperture such that the idle end is rotatably coupled to the second corner bracket; a first frame forming element is located between the first and second brackets; and wherein the frame forming element covers the roller tube.

5 Claims, 4 Drawing Sheets

(56) References Cited

FOREIGN PATENT DOCUMENTS

| | | | | | |
|---|---|---|---|---|---|
| ES | 2349218 | | 12/2010 | | |
| FR | 2663675 | | 12/1991 | | |
| FR | 2692930 | A1 * | 12/1993 | ..... | E06B 9/17 |
| GB | 2548229 | | 9/2017 | | |
| WO | 2010139945 | | 12/2010 | | |
| WO | 2018055399 | | 3/2018 | | |
| WO | 2020035613 | | 2/2020 | | |

* cited by examiner

ROLLER BLIND APPARATS

FIELD OF THE INVENTION

The present invention relates to window blinds and in particular to window blinds operated via a roller tube and which further include frame forming elements.

BACKGROUND OF THE INVENTION

It is known to secure a window blind apparatus to a frame which in turn is secured to a window. Such arrangements are known, for example, from EP1727958. However, in such cases it is necessary to mount the window blind within the frame.

In order to make it simpler to install a window blind within a frame and to reduce the number of parts required to do so, it is now proposed to utilise the corner brackets of the frame as part of the window blind apparatus in addition to the frame.

SUMMARY OF THE INVENTION

According to a first aspect of the invention, there is provided a roller blind apparatus comprising a control apparatus; an idle end; and a roller tube located between the control apparatus and the idle end, wherein the control apparatus is coupled to a first corner bracket; the idle end includes one of an idle end spindle and an aperture and a second corner bracket includes the other the idle end spindle and an aperture, wherein the idle end spindle is rotatably mounted within the aperture; a first frame forming element is located between the first and second brackets; and wherein the frame forming element covers the roller tube.

In accordance with the invention, the first corner bracket and the second corner bracket are able to support the respective parts of the blind apparatus in addition to supporting a first frame forming element of a frame.

The skilled person will appreciate that the term "roller blind apparatus" refers to any window blind that operates via a rotating tube. Such blinds include roller blinds, pleated blinds, cellular blinds, Roman blinds and such like.

In an embodiment of the invention, the roller tube defines a longitudinal axis of the apparatus; the first corner bracket includes a first engagement element arranged parallel to the longitudinal axis; the second corner bracket includes a first engagement element arranged parallel to the longitudinal axis; and the first frame forming element is secured between the first and second corner brackets by engagement with the respective first engagement elements. The first engagement elements may comprise an arm, a recess or channel or a mounting plate, for example. Suitably, the first engagement element of the first corner bracket includes an arm which extends towards the second corner bracket; and the first engagement element of the second corner bracket includes an arm which extends towards the first corner bracket. According to this embodiment, the first frame forming element may include channels which are configured and sized to receive therein a respective one of the arms. The frame forming element may be secured to the arms in any suitable way, such as for example, via fixings (e.g. screws), via a friction fit arrangement, via a snap-fit arrangement or any combination thereof.

As conventional frame forming elements include channels for connecting the frame forming elements to their respective corner brackets, the embodiment described above may be used with conventional frame forming elements.

As the first and second corner brackets are intended to form part of a frame system, the brackets suitably further include second engagement elements. Thus, in a further embodiment of the invention, the first corner bracket includes a second engagement element arranged perpendicular to the longitudinal axis; the second corner bracket includes a second engagement element arranged perpendicular to the longitudinal axis; a second frame forming element is coupled to the second engagement element of the first corner bracket and extends downwardly from the first corner bracket; and a third frame forming element is coupled to the second engagement element of the second corner bracket and extends downwardly from the second corner bracket.

The skilled person will appreciate that the second and third frame forming elements depend downwardly from the respective ends of the first framing element to form three sides of a substantially rectangular frame. A fourth frame forming element may or may not be present. In other words, the frame may or may not include a bottom frame forming element.

As with the first engagement elements, the second engagement elements may comprise an arm, a recess or channel or a mounting plate, for example. However, suitably, the second engagement element of the first corner bracket includes an arm which extends downwardly from the first corner bracket; and the second engagement element of the second corner bracket includes an arm which extends downwardly from the second corner bracket.

In an embodiment of the invention, the control apparatus includes a chain sprocket; the first corner bracket includes a support spindle and the chain sprocket is rotatably coupled to the support spindle. Accordingly, the first corner bracket may include a component of the control apparatus. Thus, the first aspect of the invention may provide a roller blind apparatus comprising a control apparatus; an idle end; and a roller tube located between the control apparatus and the idle end, wherein a first corner bracket includes a component, such as a support spindle, which forms part of the control apparatus.

In this embodiment, the first corner bracket is able to function both as part of the frame system and as part of the control end for the roller blind. The support spindle suitably projects from the first corner bracket parallel to the first engagement element (i.e. parallel to the longitudinal axis defined by the roller tube).

A roller blind control apparatus which includes a chain sprocket typically further includes an operating chain engaged with the chain sprocket, a clutch (for example a wrap spring clutch) and a drive bush operatively coupled to the chain sprocket. The operating chain is used by a user to retract or deploy the blind, the clutch prevents unwanted movement of the blind, and the drive bush is typically coupled to the roller tube and drives the roller tube to rotate about its longitudinal axis when the chain sprocket is rotated.

The clutch suitably has a released configuration in which the chain sprocket is permitted to drive the drive bush and an engaged configuration in which the drive bush is prevented from rotating. The clutch may be arranged around a friction surface defined by the support spindle such that it exerts a frictional force against the friction surface in its engaged configuration and the frictional force is reduced in its released configuration.

The operating chain may be a continuous chain, for example a continuous ball chain. For the avoidance of doubt, a ball chain comprises a continuous loop of a flexible element which carries a plurality of spaced apart, fixed ball-like members. Such ball chains are well known in the field of window blinds.

As an alternative to a control apparatus comprising a chain sprocket, the control apparatus may include an electric motor. In such embodiments, the control apparatus includes an electric motor, the first corner bracket includes one or more electric motor coupling elements and the electric motor is secured to the first corner bracket via the or each coupling element. The coupling elements may comprise bores or through holes defined by the first corner bracket.

By the term "idle end", it is meant an end of a roller blind which in use is rotatably coupled to the second corner bracket and which is opposite to the control apparatus of the blind. The idle end typically includes an idle end bush adapted to engage one end of a roller tube. The idle end bush suitably forms a bearing/axle arrangement with the idle end spindle or the aperture of the second corner bracket which allows the idle end of the roller tube to rotate relative to the second corner bracket.

In an embodiment of the invention, the second corner bracket includes the idle end spindle. In such embodiments, the idle end bush may include or define an aperture configured to rotatably receive therein a portion of the idle end spindle.

Examples of suitable idle end assemblies are defined and described in WO2010/139945, the contents of which are incorporated herein in their entirety by reference. Thus, in an embodiment of the invention, the idle end includes an idle end bush which is rotatably coupled to the idle end spindle and which is also coupled to the idle end of the roller tube such that the roller tube is rotationally fixed relative to the idle end bush, and the roller tube and idle end bush together rotate about the idle end spindle.

In a further embodiment of the invention, the apparatus further includes a control end cover which covers at least a portion of the first corner bracket. The control end cover suitably includes a profile which corresponds to the profile of the first frame forming element.

In embodiments in which the control apparatus includes a chain sprocket and associated operating chain, the control end cover may include an aperture through which the operating chain passes. Such an arrangement allows the operating chain to be operated by a user while the remainder of the control apparatus is covered by the control end cover and the first frame forming element.

In embodiments in which the control apparatus includes an electric motor, the control end cover may include an aperture which permits access to the motor, for example to permit recharging of the battery supply for the motor and/or to permit electrical wires to be connected to the motor. Such an aperture may include an aperture cover having a closed configuration in which overlies the aperture and prevents access to the interior of the control end cover, and an open configuration in which the cover is spaced from the aperture and permits access to the interior of the control end cover. Such covers are described in WO2018/055399, the contents of which are incorporated herein in their entirety by reference.

In addition to the control end cover, the apparatus may further include an idle end cover which covers the second corner bracket.

In an embodiment of the invention, the apparatus includes a four-sided frame. Thus, in this embodiment, the first corner bracket includes a second engagement element arranged perpendicular to the longitudinal axis; the second corner bracket includes a second engagement element arranged perpendicular to the longitudinal axis; a second frame forming element is coupled to the second engagement element of the first corner bracket and extends downwardly from the first corner bracket; a third frame forming element is coupled to the second engagement element of the second corner bracket and extends downwardly from the second corner bracket; the distal end of the second frame forming element carries a third corner bracket; the distal end of the third frame forming element carried a fourth corner bracket; and a fourth frame forming element is secured between the third and fourth corner brackets.

According to a second aspect of the invention, there is provided a roller blind including a roller blind apparatus as defined anywhere hereinabove and a blind substrate carried by the roller tube. The substrate may comprise a shading element or a plurality of separate shading elements, which are typically carried by the roller tube. The shading element may be in the form of a sheet, such as in a conventional roller blind, but may alternatively include a shading element typically found in pleated blinds, cellular blinds or Roman blinds, as all of these blinds may be operated via a rotating tube. The shading element may be formed from a woven or non-woven fabric and may be in the form of a laminate of two or more separate sheet elements. In embodiments in which the shading element is in the form of a sheet, the sheet may define a return portion, wherein the blind substrate includes a front shading element portion and a rear shading element portion.

In an embodiment of the first or second aspects of the invention, the first frame forming element (and also the second, third and/or fourth frame forming elements where present) is secured to a window via one or more clips which are configured to engage a rubber or polymeric gasket of a window. Such clips are described in detail in EP1727958, for example, the contents of which are incorporated herein in their entirety by reference.

Additionally or alternatively, the frame forming element(s) is/are secured to a window via a magnetic coupling arrangement including a first magnetic component secured to the window frame and a second magnetic component secured to the frame forming element(s), wherein the first and second magnetic components generate between them an attractive magnetic force. Such magnetic couplings are described and defined in GB1813471.8.

The skilled person will appreciate that the features described and defined in connection with the aspect of the invention and the embodiments thereof may be combined in any combination, regardless of whether the specific combination is expressly mentioned herein. Thus, all such combinations are considered to be made available to the skilled person.

BRIEF DESCRIPTION OF THE DRAWINGS

An embodiment of the invention will now be described, by way of example only, with reference to the accompanying drawings in which.

DETAILED DESCRIPTION OF THE PREFERRED EMBODIMENTS

For the avoidance of doubt, the skilled person will appreciate that in this specification, the terms "up", "down", "front", "rear", "upper", "lower", "width", etc. refer to the orientation of the components as found in the example when installed for normal use as shown in the Figures.

Figure 1:
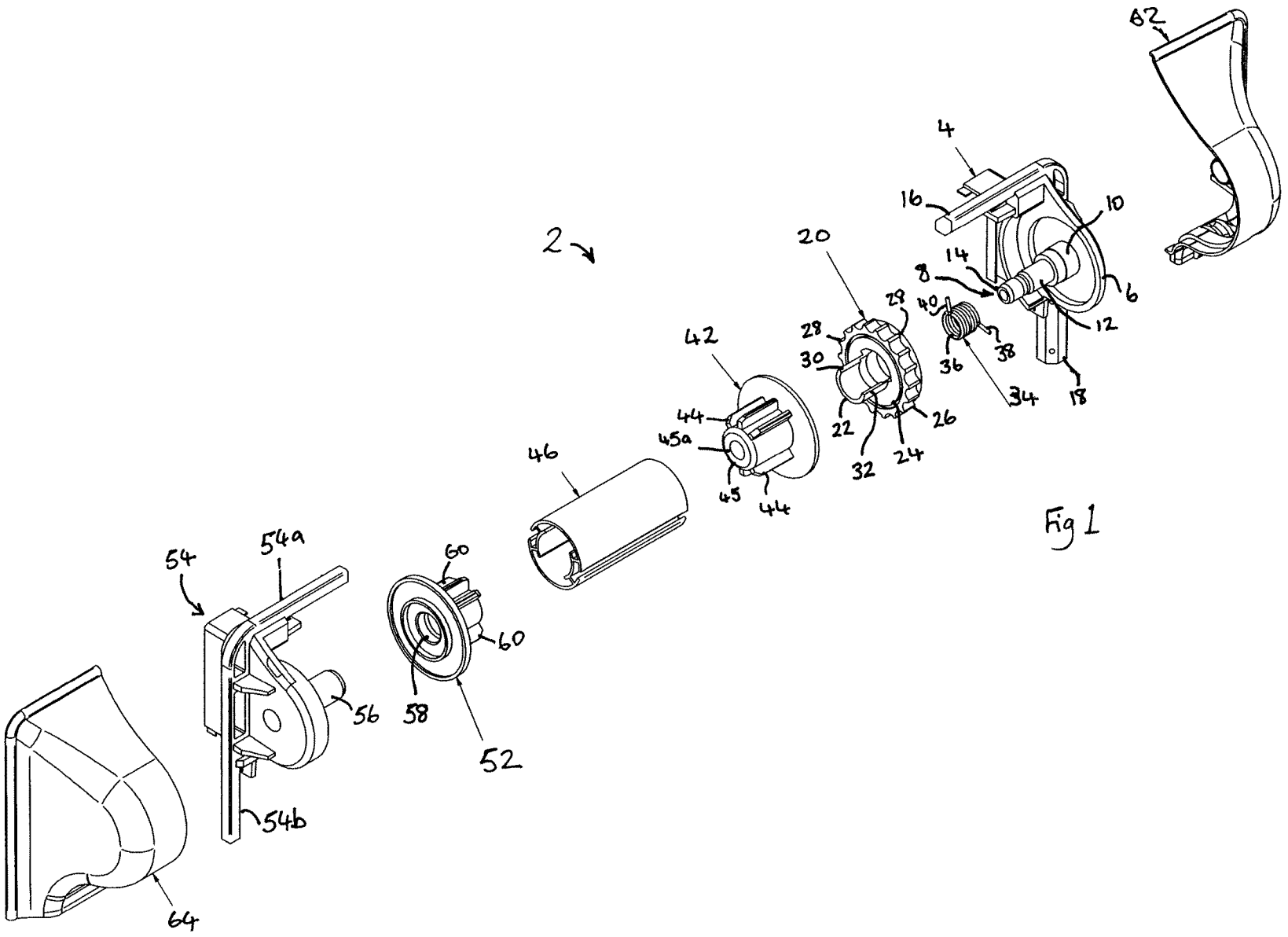
FIG. 1 shows an exploded view of a roller blind apparatus according to the first aspect of the invention with the upper frame forming element removed for clarity.

FIG. 1 shows an exploded view of a roller blind apparatus 2. The apparatus comprises a first corner bracket 4 including a main body portion 6. Projecting from the main body portion 6 is a spindle 8 which defines a cylindrical bearing portion 10, a cylindrical friction surface 12 and a retaining portion 14 at the distal end thereof. The spindle 8 projects substantially horizontally in use.

The first corner bracket 4 further includes a first engagement element in the form of a first arm 16 which projects from the main body portion 6 in a direction parallel to the spindle 8 (i.e. substantially horizontal in use), and a second engagement element in the form of a second arm 18 which projects downwardly (i.e. substantially vertically in use) from the main body portion 6 such that the second arm 18 projects perpendicularly to the first arm 16.

A chain sprocket 20 is rotationally located about cylindrical bearing portion 10. The chain sprocket includes a truncated cylindrical portion 22 and a flange 24 at one end thereof. The peripheral edge portion 26 of the flange 24 defines a series of teeth 28 with pockets defined between adjacent teeth 28 such that the flange 24 functions as a toothed wheel. The truncated cylindrical portion defines a pair of parallel contact edges 30, 32.

A wrap spring clutch 34 is located around the cylindrical friction surface 12 to act as a clutch. The wrap spring clutch 34 includes a cylindrical body portion 36 which is located within the cavity defined by the truncated cylindrical portion 22 of the chain sprocket 20. The wrap spring clutch 34 further includes a pair of radially outwardly projecting tangs 38, 40. The tangs 38, 40 extend beyond the truncated cylindrical portion 22 of the chain sprocket 20 and each tang 38, 40 engages a respective one of the contact edges 30, 32 of the truncated cylindrical portion 22.

In use, the cylindrical body portion is located around the friction surface 12 of the spindle 8.

A drive bush 42 is carried by the truncated cylindrical portion 22 of the chain sprocket 20. The arrangement between the drive bush 42, the chain sprocket and the wrap spring clutch 34 is well known in the art and as such will not be described in detail herein.

The drive bush 42 includes a number of radially outwardly projecting splines 44.

A distal end face 45 of the drive bush 42 defines an aperture 45*a* which is sized and configured to snap fit over the retaining portion 14 of the spindle 8 such that the retaining portion 14 prevents the unintended disengagement of the drive bush 42 from the spindle 8 and consequently maintains the chain sprocket 20 on the spindle 8.

A roller tube 46 engages at one end thereof with the splines 44 of the drive bush 42 such that the roller tube is rotationally locked relative to the drive bush 42.

An operating chain 48 (shown in FIGS. 2 and 3) is engaged with the chain sprocket teeth 28 such that balls 50 of the operating chain 48 are located within respective pockets defined between adjacent teeth 28.

Rotation of the operating chain 48 causes the chain sprocket 20 to rotate about the spindle 8. One of the contact edges 30, 32 of the chain sprocket 20 engages the corresponding tang 38, 40 of the wrap spring clutch 34 which slightly increases the diameter of the cylindrical body portion 36 of the wrap spring clutch 34 and thereby reduces the friction between the wrap spring clutch 34 and the friction surface 12 of the spindle 8. With a reduced frictional contact, the wrap spring clutch 34 and the chain sprocket 20 are able to rotate about the spindle 8.

Rotation of the chain sprocket 20 causes a corresponding rotation of the drive bush 42 via the interengagement between the two components, which in turn causes a corresponding rotation of the roller tube 46.

At the opposite end of the roller tube 46 is an idle end bush 52 and a second corner bracket 54. The second corner bracket 54 is similar to the first corner bracket 4, except that instead of a stepped spindle 8, the second corner bracket 54 includes a simple cylindrical spindle 56.

Similar to the first corner bracket 4, the second corner bracket includes a pair of perpendicularly arranged engagement arms 54*a*, 54*b*.

The idle end spindle 56 provides a bearing for the idle end bush 52 which includes a corresponding cylindrical bore 58. The outer surface of the idle end bush 52 includes a similar arrangement of radially extending splines 60 as the drive bush 42.

A control end cover 62 and a corresponding idle end cover 64 cover respectively the first corner bracket 4 and the second corner bracket 54 in use.

Figure 2:
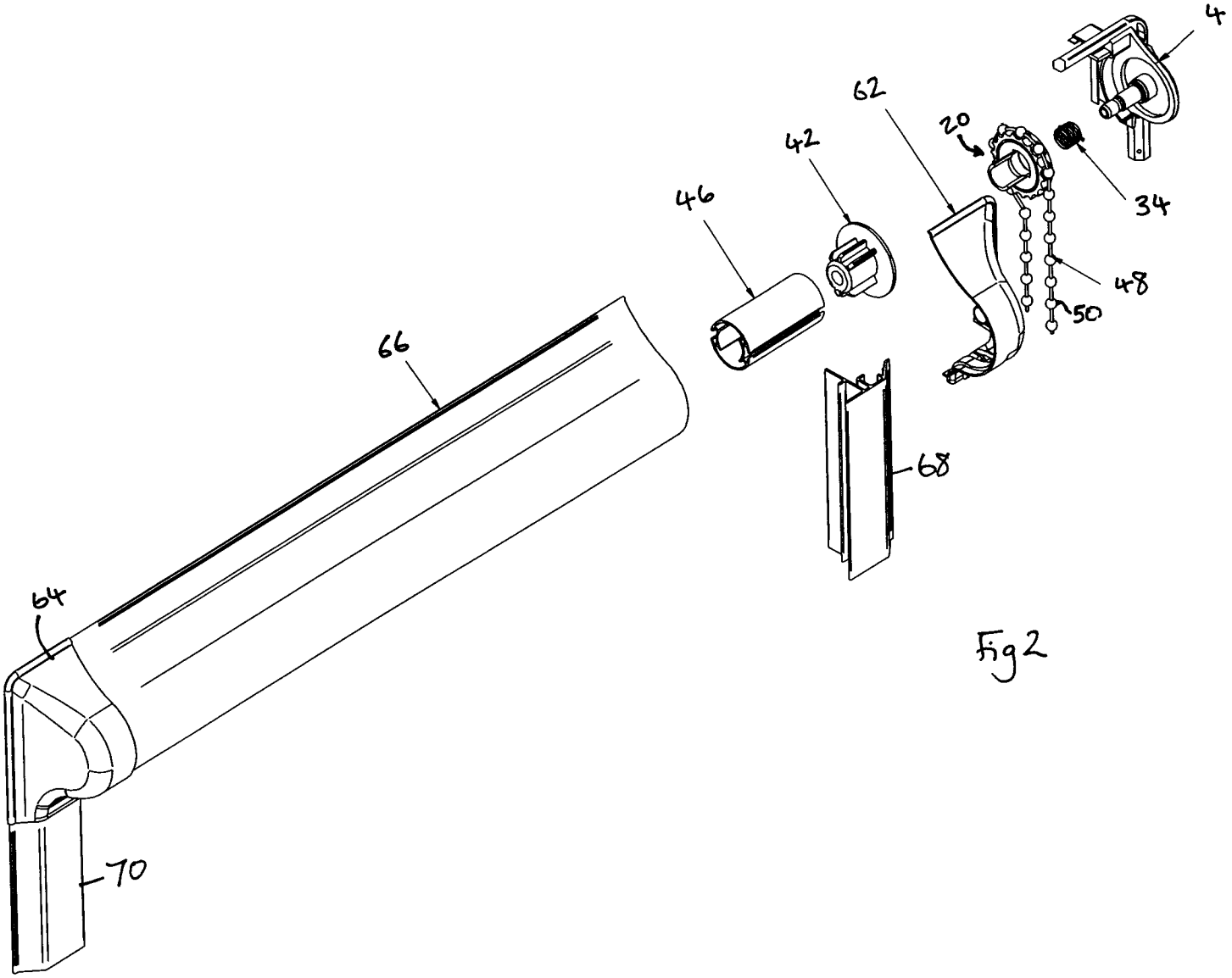
FIG. 2 shows a partially exploded view of the roller blind apparatus shown in FIG. 1 with the upper frame forming element in place.

FIG. 2 shows an arrangement with an upper frame forming element 66 connected to the second corner bracket 54 (not shown), which is covered by the idle end cover 64. Channels (not shown) in the upper frame forming element 66 engage with the first arms 16, 54*a* of the first and second corner brackets 4, 54 to secure the upper frame forming element 66 to the corner brackets 4, 54.

FIG. 2 further shows a first side frame forming element 68 and a second side frame forming element 70. The first and second side frame forming elements 68, 70 have the same profile, but are different to the upper frame forming element 66 as the first and second side frame forming elements 68, 70 do not need to cover the roller tube 46. Each of the first and second side frame forming elements 68, 70 include similar engagement channels as the upper frame forming element 66 and these channels receive therein the second arms 16, 54*b* of the first and second corner brackets 4, 54 in order to secure the first and second side frame forming elements 68, 70 to the respective corner bracket 4, 54.

The first and second arms 14, 16, 54*a*, 54*b* are secured in their respective channels via screws. However, it will be appreciated that alternative fixings, such as a snap-fit arrangement or a friction fit arrangement may be used to secure the frame forming elements 66, 68, 70 to their respective corner brackets.

Figure 3:
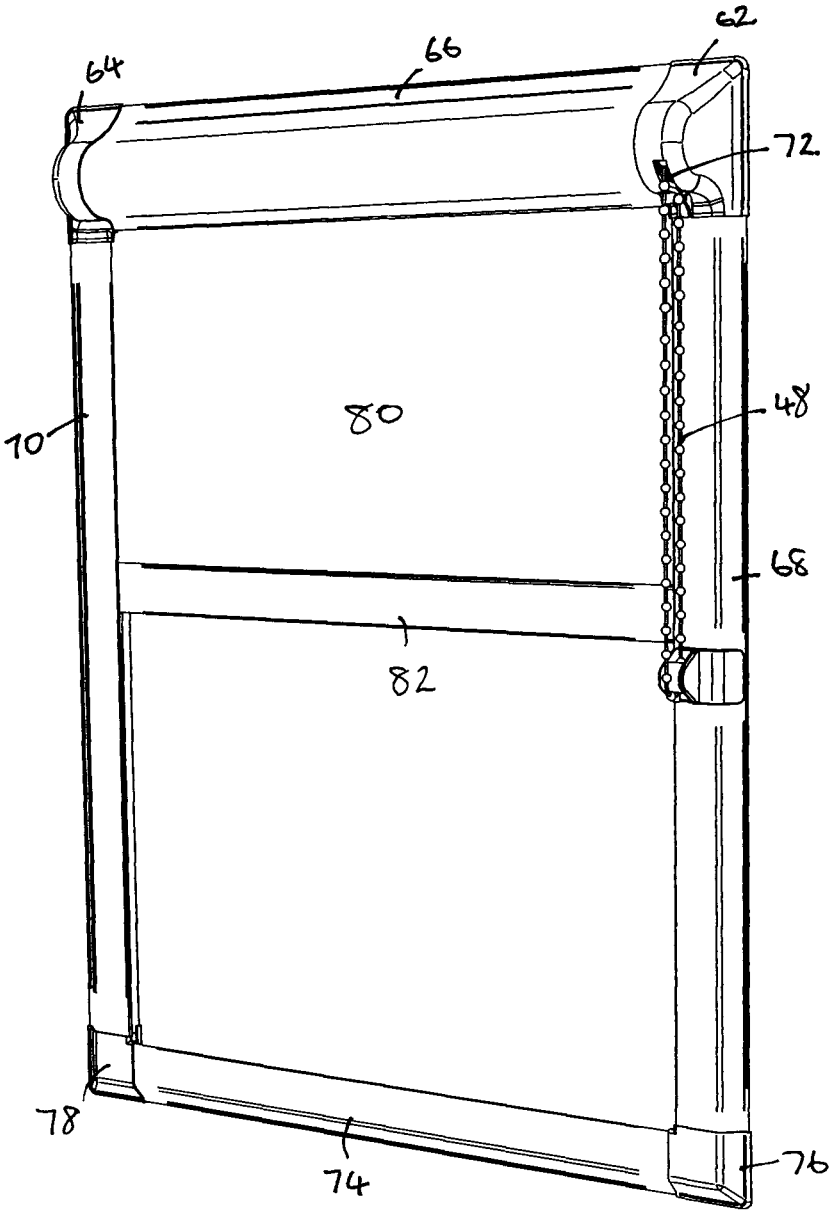
FIG. 3 shows a perspective view of a roller blind according to the second aspect of the invention with the roller blind in a partially retracted configuration.

FIG. 3 shows a roller blind which shows in more detail the arrangement of the operating chain 48 and the control end cover 62. As shown in FIG. 3, the control end cover 62 defines therethrough an aperture 72 through which the operating chain 48 passes such that a portion of the operating chain 48 lies outside of the frame forming elements.

FIG. 3 also shows a lower frame forming element 74, which has the same profile as the first and second side frame forming elements 68, 70. The lower frame forming element 74 is connected to the first and second side frame forming elements 68, 70 via respective bottom corner brackets (not shown). Each of the bottom corner brackets includes a pair of perpendicularly arranged engagement arms, similar to the engagement arms of the corner brackets 4, 54 shown in FIG. 1, wherein each of the engagement arms is secured within a respective channel defined by the side frame forming elements 68, 70 and the lower frame forming element 74. The bottom corner brackets are covered by bottom corner bracket covers 76, 78.

A roller blind sheet 80 is wound around the roller tube 46 and depends downwards from the upper frame forming element 66. A roller blind bottom bar 82 is secured to a bottom edge portion of the roller blind sheet 80 in order to provide additional weight to the bottom portion of the roller blind sheet 80.

Side edge portions of the roller blind sheet 80 and the roller blind bottom bar 82 are covered by the inwardly facing side edge portions of the first and second side frame forming elements 68, 70 such that the side edge portions of the roller blind sheet 80 and the roller blind bottom bar 82 move vertically within channels defined between the side frame forming elements 68, 70 and a window frame, or a glazing panel of a window frame, to which the frame is secured.

Figure 4:
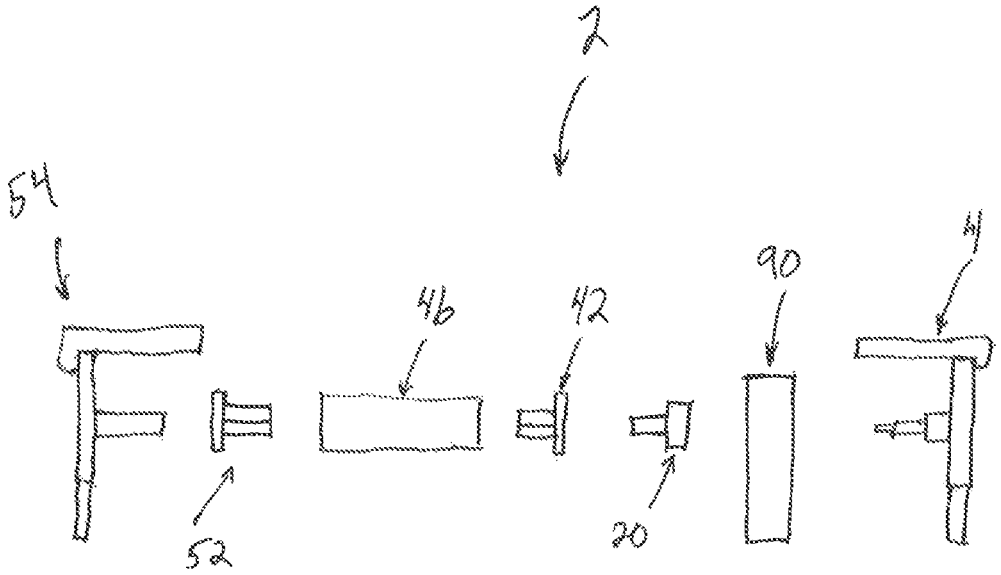
FIG. 4 shows a schematic exploded view of a roller blind apparatus including an electric motor.

FIG. 4 shows an arrangement of the control apparatus with an electric motor 90 for rotating drive bush 42.

The roller blind arrangement shown in FIG. 3 may be secured to a window frame via clips, such as those described in EP1727958. Additionally or alternatively, the roller blind arrangement may be secured to a window frame via a magnetic coupling arrangement as described in GB patent application No. 1813471.8.

The invention claimed is:

1. A roller blind apparatus comprising a control apparatus; an idle end; and a roller tube located between the control apparatus and the idle end, wherein the control apparatus is coupled to a first corner bracket; the idle end includes one of an idle end spindle and an aperture and a second corner bracket includes the other of the idle end spindle and the aperture, wherein the idle end spindle is rotatably mounted within the aperture such that the idle end is rotatably coupled to the second corner bracket; a first frame forming element is located between the first and second corner brackets; wherein the frame forming element covers the roller tube; wherein the roller tube defines a longitudinal axis of the apparatus; the first corner bracket includes a first arm which is arranged parallel to the longitudinal axis and extends towards the second corner bracket; the second corner bracket includes a first arm which is arranged parallel to the longitudinal axis and extends towards the first corner bracket; and the first frame forming element is secured between the first and second corner brackets by engagement with the respective first arms; wherein the first corner bracket includes a second arm arranged perpendicular to the longitudinal axis and which extends downwards; the second corner bracket includes a second arm arranged perpendicular to the longitudinal axis and which extends downwards; a second frame forming element is coupled to the second arm of the first corner bracket and extends downwardly from the first corner bracket; and a third frame forming element is coupled to the second arm of the second corner bracket and extends downwardly from the second corner bracket; the control apparatus includes a chain sprocket, a drive bush, a clutch disposed between the chain sprocket and the drive bush, and an operating chain engaged with the chain sprocket; the apparatus further includes a control end cover which covers the first corner bracket; and wherein the control end cover includes an aperture through which the operating chain passes.

2. A roller blind apparatus according to claim 1, wherein the second corner bracket includes a spindle and the idle end defines an aperture.

3. A roller blind apparatus according to claim 2, wherein the apparatus further includes an idle end cover which covers the second corner bracket.

4. A roller blind apparatus according to claim 3, wherein the distal end of the second frame forming element carries a third corner bracket; the distal end of the third frame forming element carries a fourth corner bracket; and a fourth frame forming element is secured between the third and fourth corner brackets.

5. A roller blind including a roller blind apparatus according to claim 1 and a blind substrate carried by the roller tube.

* * * * *